United States Patent [19]

Nakajima et al.

[11] 4,182,289

[45] Jan. 8, 1980

[54] VARIABLE VALVE TIMING SYSTEM FOR INTERNAL COMBUSTION ENGINE

[75] Inventors: Yasuo Nakajima, Yokosuka; Yoshimasa Hayashi, Yokohama, both of Japan

[73] Assignee: Nissan Motor Co., Limited, Yokohama, Japan

[21] Appl. No.: 741,120

[22] Filed: Nov. 11, 1976

[30] Foreign Application Priority Data

Nov. 17, 1975 [JP] Japan ..... 50-137938

[51] Int. Cl.[2] ..... F01L 1/24

[52] U.S. Cl. ..... 123/90.16; 123/90.15; 123/90.18; 123/90.39

[58] Field of Search ..... 123/90.1, 90.15, 90.16, 123/90.18, 90.21, 90.39

[56] References Cited

U.S. PATENT DOCUMENTS

| | | | |
|---|---|---|---|
| 2,397,511 | 4/1946 | Schreck | 123/90.16 |
| 2,678,641 | 5/1954 | Ryder | 123/90.16 |
| 2,823,655 | 2/1958 | Repko | 123/90.16 |
| 2,851,023 | 9/1958 | Durkan | 123/90.16 |
| 2,880,712 | 4/1959 | Roan | 123/90.16 |
| 3,730,150 | 5/1973 | Codner, Jr. | 123/90.18 |
| 3,945,355 | 3/1976 | Calviac | 123/90.18 |

*Primary Examiner*—Martin P. Schwadron
*Assistant Examiner*—A. Michael Chambers

[57] ABSTRACT

A valve operating mechanism comprising a valve, a cam, a cam shaft for rotating the cam about an axis, a rocker lever rotatably mounted about a rocker lever shaft. The rocker lever is axially movable along the rocker lever shaft. The cam is tapered in the longitudinal direction of the axis and has a uniform cross sectional shape. The rocker lever has an arm formed with a surface engaging the cam and an opposite arm provided with means for engaging the end of a valve stem of the valve.

7 Claims, 8 Drawing Figures

VARIABLE VALVE TIMING SYSTEM FOR INTERNAL COMBUSTION ENGINE

BACKGROUND OF THE INVENTION

The present invention relates to an internal combustion engine and more particularly to a variable valve timing system for an internal combustion engine.

Exhaust gas recirculation (EGR) is widely employed to reduce nitrogen oxides (NOx) emissions from internal combustion engines. EGR can be accomplished either externally or internally. The external method involves diverting the exhaust gases from some point in the exhaust system back to the intake system. To reduce NOx emissions to a certain sufficiently low level, the amount of EGR must be increased considerably. Increasing the flow rate of the exhaust gases through the intake system to meet the demand above will increase the deposition of carbon on the interior wall of the intake system and EGR system to such an degree as to cause deterioration of the induction efficiency of the engine and the reduction efficiency of NOx removal. To alleviate this problem, it has been proposed to increase the internal EGR to suppress the external EGR. All naturally aspirated engines have some inherent EGR; that is, some portion of the products of combustion remain in the cylinder (residual gas) which mix with the incoming fresh charge before combustion is initiated. The amount of residual gas can be controlled by increasing or decreasing the valve overlap period during which both inlet and exhaust valves are open.

As well as having the potential for reducing Nox, the variation of valve overlap has a direct effect on engine combustion and power output. Large valve overlap enhances power output at high-speed wide-open throttle operation, while low-speed part-throttle operation requires low overlap for smooth running. These interrelationships indicate that a variable valve timing system capable of adjusting valve overlap while running may be desirable for optimizing engine operation for both emissions and performance.

To accomplish this, a known variable valve timing system comprises a cam shaft axially movable by an actuator. The cam shaft has a cam to operate a valve through a rocker arm or lever. The cam has a plurality of valve control tracks each associated with a different range of engine operation. The changeover of the system from one track to another is effected by axial translation of the cam shaft by the actuator. Because the cam shaft is driven by the engine to rotate at high speeds, there exist some difficulties to axially move the cam shaft by the actuator. Because the cam must have different valve control tracks, it is not easy to manufacture. Therefore this known system is complicated in construction.

SUMMARY OF THE INVENTION

It is an object of the present invention to provide a simply constructed, variable valve timing system.

It is another object of the present invention to provide a variable valve timing system capable of providing large valve overlap period during which both inlet and exhaust valves are open under operation of the engine at high speeds and low valve overlap under operation at low speeds.

BRIEF DESCRIPTION OF THE DRAWINGS

These objects, features and advantages of the present invention will be clear from the following description in connection with the accompanying drawings, of an overhead cam internal combustion engine according to this invention in which.

DESCRIPTION OF THE PREFERRED EMBODIMENTS

Figure 1:
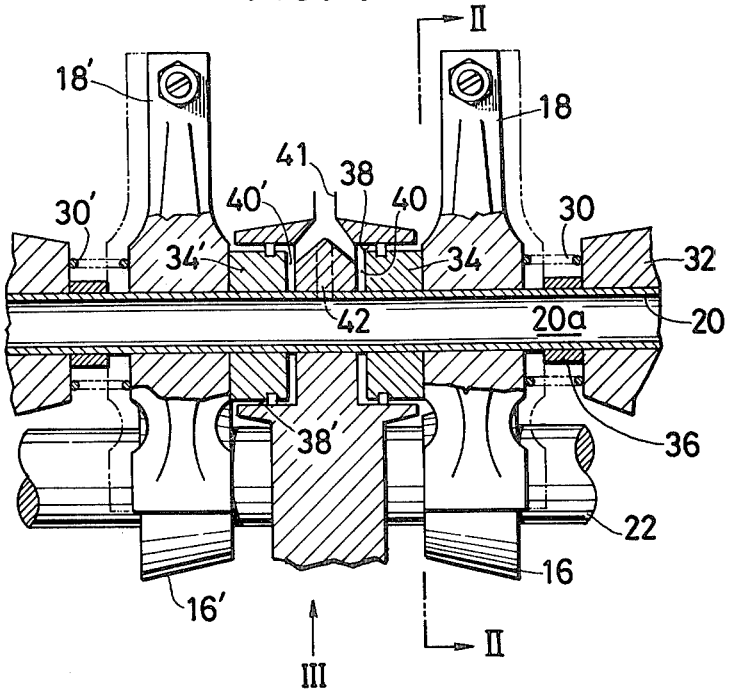
FIG. 1 is a plan view, partly in section, of a variable valve timing system according to the present invention.
Figure 2:
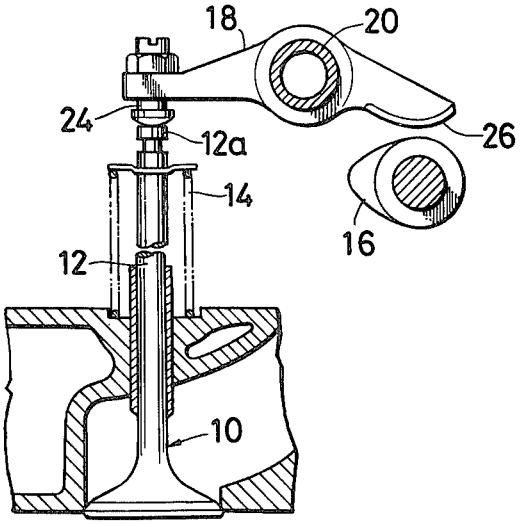
FIG. 2 is a section through line II—II of FIG. 1.
Figure 3:
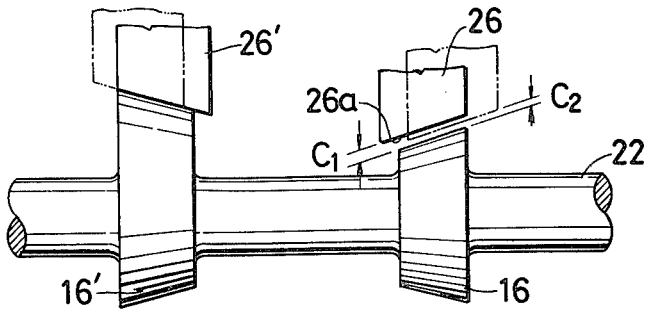
FIG. 3 is a view as viewed, in FIG. 1, along an arrow III.

Referring now to the accompanying drawings and more particularly to FIGS. 1–3 thereof, there is shown a variable valve timing system according to the present invention in which an exhaust valve is indicated by reference numeral 10 (see FIG. 2). The exhaust valve 10 has a stem 12 and equipped with a valve spring 14 which biases the valve 10 toward a closed position, the position being illustrated in FIG. 2. The valve 10 is operated by a cam 16 through a rocker lever 18 rockably mounted on a rocker lever shaft 20. The cam 16 is fixedly mounted on or integrally formed with a cam shaft 22 that is driven by an engine crank shaft, not shown, to rotate about an axis parallel to the rocker lever shaft 20. The rocker lever 18 is mounted on the rocker lever shaft 20 at an intermediate portion thereof. It has at one end thereof an adjustable tappet 24 (see FIGS. 4 and 6 also) positioned to contact with a stem end 12*a* of the stem 12 and at opposite end thereof a follower 26 cooperating with the cam 16.

As best seen in FIG. 3, the follower 26 has a surface 26*a* which is positioned in active position with the cam 16. The surface 26*a* of the follower 26 extends along a line that is disposed within a plane in which the axis of the cam shaft 22 lies and that forms an angle with the axis of the cam shaft.

As best seen in FIG. 1, the rocker lever 18 is movable along the rocker lever shaft 20 between a first position illustrated by solid line in which a clearance between the surface 26*a* of the follower 26 and the cam 16 (see FIG. 3) is maximum, the clearance being indicated by $C_1$, and a second position illustrated by imaginary line in which a clearance between the surface 26*a* of the follower 26 and the cam 16 is minimum, the clearance being indicated by $C_2$ (see FIG. 3).

Figure 5:
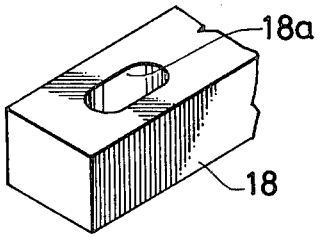
FIGS. 5 and 6 are perspective views of a portion of a rocker arm and a tappet, respectively.
Figure 4:
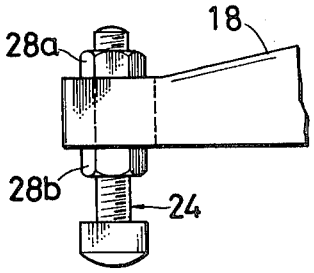
FIG. 4 is an enlarged fragmentary view of FIG. 2.
Figure 6:
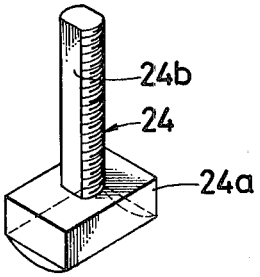

As best seen in FIGS. 4–6, the adjustable tappet 24 or clearance adjustor has a portion 24*a* which contacts with the stem end 12*a*. The portion 24*a* extends in a direction parallel to the rocker lever shaft 20 so that the portion 24*a* is in contact with the stem end 12*a* irrespective of positions of the rocker 18 during its movement along the rocker lever shaft 20. The adjustable tappet 24 has a plunger portion 24*b* formed with a screw thread. The plunger portion 24*b* extends through an elongated hole 18*a* of the rocker arm 18 and the tappet 24 can be appropriately positioned relative to the stem end 12*a* by means of nuts 28*a* and 28*b*.

The rocker lever 18 is biased toward the illustrated position by a return spring 30 compressedly disposed between a spring retainer 32 securely attached to the rocker lever shaft 20 or cylinder head and the rocker lever 18, as shown in FIG. 1. The rocker lever 18 is moved against the action of the return spring 30 toward the position illustrated by the imaginary line by means of a piston 34 of a hydraulic actuator. A stopper 36 is provided to define the position illustrated by the imaginary line. The hydraulic actuator comprises a cylinder 38 in which the piston 34 is sealingly slidably disposed to define a chamber 40. The chamber 40 communicates with a lubricating oil supply pump, not shown, driven by the engine through a conduit 41. The pump provides lubricating oil having a pressure which increases with increase of revolution speed of the engine (engine rpm). To supply the lubricating oil to portions of the rocker lever shaft 20 which require lubrication, the rocker lever shaft 20 is hollowed to provide a passage 20*a* for the lubricating oil.

Although in the preceding the conduit 41 is provided to establish communication between the chambers 40 and 40' and the pump, the communication may be established by a passage 42 drilled through a body defining the cylinders 38 and 38'. The passage 42 communicates at one end with the cylinders 38 and 38' and opens at the other end to the passage 20*a* formed in the rocker lever shaft 20.

During operation at idle or at low speed, the rocker lever 18 is in the position illustrated by the solid line because pressure of the lubricating oil supplied by the oil pump is not high enough to cause the piston 34 to move the rocker lever 18 rightwardly against the return spring 30. When the pressure increases above a predetermined level, the piston 34 commences to move the rocker lever 18 toward the position illustrated by the imaginary line against the return spring 30. During operation at high speed in which the pressure of the lubricating oil is higher than the predetermined level, the rocker lever 18 moves toward the position illustrated by the imaginary line. It will be recognized that during operation at idle or low speed, the rocker lever 18 is in the position illustrated by the solid line and the clearance between the cam 16 and the follower 26 is maximum, and during operation at high speed, the clearance decreases as engine speed increases.

Referring to the cam 16, it is tapered axially so the edge of the cam 16 makes line-to-line contact with the surface 26*a* of the follower 26 and has the same profile in any section taken transversely through the cam 16.

Referring to FIG. 1, an inlet valve, not shown, is operated by a similar cam 16' to the cam 16 through a similar rocker lever 18' to the rocker lever 18. The rocker lever 18' is in the position illustrated by solid line during operation at idle and low speed because force of a return spring 30' overcomes force of a piston by pressure of oil within a chamber 40'. The rocker lever 18' is moved toward a position illustrated by imaginary line during operation at high speed, decreasing a clearance between the cam 16 and its follower 26' formed on the rocker lever 18' from $C_1$ (the maximum) to $C_2$ (the minimum).

The operation of the variable valve timing system described in the preceding will be explained.

Figure 7:
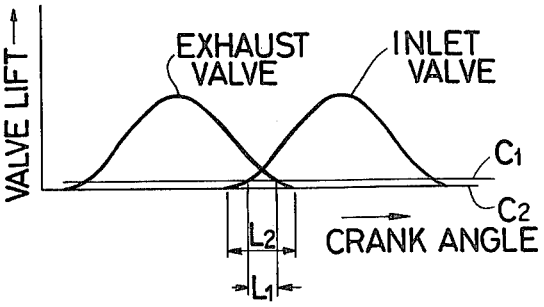
FIG. 7 is a graph depicting an effective valve lift and crank angle on valve overlap.
Figure 8:
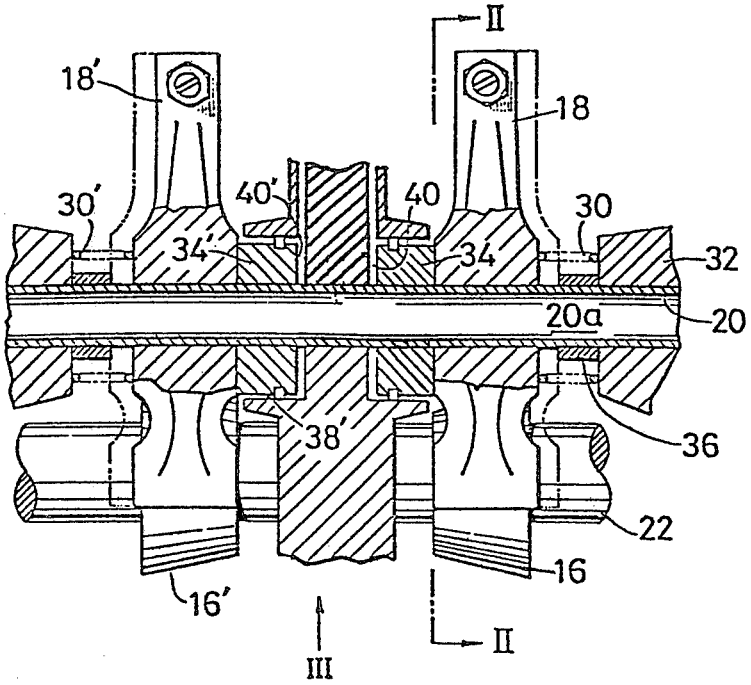
FIG. 8 is a view similar to that of FIG. 1 but showing an alternative arrangement of the hydraulic chambers.

When the engine operates at idle or at low speed, the rocker levers 18 and 18' for the exhaust and inlet valves, respectively are in the positions illustrated by the solid lines, the clearance between each of the cams and its associated follower is maximum ($C_1$). Under this condition, valve overlap period during which the inlet and exhaust valves are open is the lowest, as indicated at $L_1$ as shown in FIG. 7.

When the engine operates at high speed, the rocker levers 18 and 18' take the positions illustrated by the imaginary lines thereby the clearance reducing to the minimum ($C_2$). Under this condition, the valve overlap becomes the largest, as indicated at $L_2$ as shown in FIG. 7.

It will now be recognized that the internal EGR during operation at idle or low speed is much for smooth running and for fuel economy, while the internal EGR during operation at high speed is great.

Although in the preceding embodiment the valve overlap is varied by varying the valve timing of both of the inlet and exhaust valves, the variation of the valve overlap may be effected by varying the valve timing of the exhaust valve alone by selectively supplying oil or fluid under pressure into chamber 40 only.

The valve overlap may be varied by varying the valve timing of the inlet valve alone by selectively supplying oil or fluid under pressure into chamber 40' only. This causes throttling of fresh intake charge because during operation at high speed opening timing of the inlet valve is delayed. Thus the intake charge will be mixed well to provide high output during operation at high speed.

What is claimed is:

1. A variable valve timing system for an overhead cam internal combustion engine having an overhead cam comprising:

a valve having stem and biased towards a closed position by a valve spring;

a rocker lever shaft;

a cam shaft having an axis parallel to said rocker lever shaft;

said cam secured to said cam shaft, said cam being tapered in the longitudinal direction along said axis and having a uniform cross-sectional shape;

a rocker lever being axially reciprocally movable and pivotably mounted on said rocker lever shaft, said rocker lever having a tappet at one end portion thereof positioned to contact said stem and a follower at the opposite end portion thereof with a follower having a surface position to operatively engage said cam; and a cylinder mounted coaxially with said rocker lever shaft and an annular piston sealingly slidably disposed in said cylinder and on said rocker lever shaft respectively, said piston abutting said rocker lever at one end and defining at the other end a chamber within said cylinder, said chamber communicating with pump means for providing fluid having pressure which increases with the increase in revolution speed of the engine.

2. A variable valve timing system as set forth in claim 1 in which a conduit is provided to establish communication between said chamber and said pump means.

3. A variable valve timing system as set forth in claim 1 in which a passage is formed through a body defining said cylinder, said passage communicating at one end with said chamber and opening at the other end to a passage formed through said rocker lever shaft to establish communication between said chamber and said pump means.

4. In an overhead cam internal combustion engine, having a cam shaft, a cylinder head;

said cam shaft rotatably disposed in said cylinder head;

a rocker lever shaft fixedly disposed in said cylinder head;

first and second rocker levers journalled on said rocker lever shaft so as to oscillatable about and axially movable along said rocker lever shaft;

first and second valves operatively disposed in said cylinder head, each of said first and second valves having a stem;

first and second tappets respectively connected to said first and second rocker levers for respectively abutting said stems of said first and second valves to induce reciprocative motion therein, said first and second tappets having part cylindrical surfaces parallel with said rocker lever shaft and which permit said rocker levers to move along said rocker lever shaft and maintain an operative connection between said first and second valve stems;

first and second cams provided on said cam shaft each of said cams having a uniform cross sectional shape which tapers in the longitudinal direction of said cam shaft;

first and second surfaces formed respectively on said first and second rocker levers for engaging said first and second cams, said first and second surfaces being arranged to mate with the tapers of said first and second cams;

first and second cylinders arranged coaxially of said rocker lever shaft, said first and second cylinders being communicable with a source of hydraulic fluid under pressure;

first and second annular pistons slidably received on said rocker lever shaft and slidably received in said first and second cylinders respectively to define first and second hydraulic fluid chambers therein, said first piston having an end abutting said first rocker lever and said second piston having an end abutting said second rocker lever; and first and second springs for respectively biasing said first and second rocker levers against said first and second pistons respectively the arrangement of the foregoing being such that upon introduction of hydraulic fluid under pressure into said first cylinder said first rocker lever will be driven against the bias of said first biasing means along said rocker lever shaft and upon introduction of hydraulic fluid under pressure into said second cylinder said second rocker lever is driven along said rocker lever shaft against the bias of said second biasing means.

5. An internal combustion engine as claimed in claim 4, wherein said rocker lever shaft is hollow to define a hydraulic fluid passageway therein, said passageway communicating with said first and second chambers via at least one bore formed through the wall of said hollow rocker lever shaft whereby lubrication fluid is provided to said passageway.

6. An internal combustion engine as claimed in claim 4, in which said first and second chambers individually communicate with said source of hydraulic fluid under pressure so as to be selectively suppliable with pressurized hydraulic fluid.

7. In an overhead cam internal combustion engine, having a cam shaft, a cylinder head;

said cam shaft rotatably disposed in said cylinder head;

a rocker lever shaft fixedly disposed in said cylinder head;

first and second rocker levers journalled on said rocker lever shaft so as to be oscillatable about and axially movable along said rocker lever shaft;

an inlet and exhaust valve operatively disposed in said cylinder head, said inlet and exhaust valves each having a stem engageable with said first and second rocker levers respectively;

tappet means provided on each of said first and second rocker levers for permitting said rocker levers to move axially along said rocker lever shaft while maintaining operative engageability with the stems of said inlet and exhaust valves;

first and second tapered cams provided on said cam shaft respectively engageable with said first and second rocker levers;

first and second cylinders provided adjacent said rocker lever shaft;

first and second pistons respectively received in said first and second cylinders, said first piston having an end in abutment with said first rocker lever and said second piston having an end in abutment with said second rocker lever; and first and second biasing means for biasing said first and second rocker levers respectively into abutment with said first and second pistons;

the arrangement of the foregoing being such that upon introduction of hydraulic fluid under pressure into said first cylinder said first rocker lever will be driven against the bias of said first biasing means along said rocker lever shaft and upon introduction of hydraulic fluid under pressure into said second cylinder said second rocker lever is driven along said rocker lever shaft against the bias of said second biasing means.

* * * * *